US008250769B2

(12) United States Patent
Edmundson

(10) Patent No.: US 8,250,769 B2
(45) **Date of Patent: *Aug. 28, 2012**

(54) ARCHERY BOW SIGHT DISTANCE INDICATOR

(75) Inventor: Jerry Edmundson, Poplar Bluff, MO (US)

(73) Assignee: Jerrmatt, LLC, Poplar Bluff, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/285,678

(22) Filed: Oct. 31, 2011

(65) Prior Publication Data

US 2012/0042528 A1 Feb. 23, 2012

Related U.S. Application Data

(63) Continuation of application No. 12/762,852, filed on Apr. 19, 2010, now Pat. No. 8,046,927.

(51) Int. Cl.
*F41G 1/467* (2006.01)
*G01C 9/00* (2006.01)

(52) U.S. Cl. ..... 33/265; 124/87; 33/377; 33/389

(58) Field of Classification Search ..... 33/265, 33/348, 354, 370–374, 376, 379, 384, 387–389, 33/451; 124/87

See application file for complete search history.

(56) References Cited

U.S. PATENT DOCUMENTS

| | | | | |
|---|---|---|---|---|
| 2,756,512 | A | 7/1956 | Pettit | |
| 3,289,300 | A * | 12/1966 | Jordan | 33/265 |
| 3,673,697 | A | 7/1972 | Wasson | |
| 4,616,422 | A * | 10/1986 | Gaddy | 33/265 |
| 4,846,141 | A * | 7/1989 | Johnson | 124/87 |
| 5,850,700 | A * | 12/1998 | Capson et al. | 33/265 |
| 7,200,944 | B2 * | 4/2007 | Rager | 33/265 |
| 7,574,811 | B2 * | 8/2009 | Kurtzhals et al. | 33/265 |
| D619,188 | S * | 7/2010 | Omley et al. | D22/107 |
| 8,046,927 | B1 * | 11/2011 | Edmundson | 33/265 |

* cited by examiner

*Primary Examiner* — Christopher Fulton
(74) *Attorney, Agent, or Firm* — Shook, Hardy & Bacon L.L.P.

(57) ABSTRACT

A distance indicating mechanism can be used in combination with a bow sight to quickly determine distances to targets from an elevated position. The distance indicating mechanism has a generally circular, fluid-filled tubular device with one or more adjustable indicators located thereon. The indicators are positionable to correspond with the fluid level in the tubular device to indicate the orientation of the mechanism when aiming at a known distance. Each indicator generally corresponds to a sight pin of a bow site that indicates a corresponding linear distance for which an arrow will be at a desired vertical position when shot by a bow operator.

16 Claims, 12 Drawing Sheets

ARCHERY BOW SIGHT DISTANCE INDICATOR

CROSS-REFERENCE TO RELATED APPLICATIONS

The present application is a continuation of pending U.S. application Ser. No. 12/762,852, entitled "ARCHERY BOW SIGHT DISTANCE INDICATOR", filed Apr. 19, 2010.

TECHNICAL FIELD

The present invention relates generally to archery equipment. More particularly, embodiments of the present invention relate to a device and method for quickly determining a distance to a target from a known vertical position to ascertain the proper trajectory needed for the shot.

BACKGROUND OF THE INVENTION

In the sport of archery or bow hunting, as with other forms of hunting or shooting, accuracy is imperative, since the bow operator will often only have one shot at his target. A well known accessory to a hunting bow is a bow sight, which is a device that is mounted on the bow to help the shooter aim an arrow and improve shot accuracy.

Bow sights can vary in design and complexity. A bow sight common in the prior art utilizes a series of pins that are positioned in a track such that when an operator's line of sight is aligned with the respective pin and the arrow is shot from the bow, the arrow will be at a desired height at a predetermined linear distance. The pins are typically set to establish known intervals of linear distances from the shooter. For example, a bow sight having three pins may have them set to correspond to distances of 15, 20, and 25 yards. As the operator's line of sight moves from one pin to another, the orientation of the bow is rotated with respect to the operator, thereby changing the trajectory of the arrow. By increasing the trajectory, the arrow will fly farther before falling to the desired height. The pins are set by the operator to provide a visual indicator as to when the bow is in the proper orientation such that the arrow will be at the proper height a known distance from the bow.

Bow sights provide a sufficient aid to a hunter when the hunter is to shoot a known distance. However, when the bow hunter is at an elevated position, such as in a tree stand where he can watch a larger area of land for potential targets, the distance to a target that can move often cannot be easily determined quickly and to the level of accuracy necessary to know what distance the arrow should be aimed. In order to determine the exact distance to a target from an elevated position, unless the target moves past a landmark at a known distance, bow hunters are forced to use a distance finder each time. The hunter must then raise the bow and align his line of sight with a pin having a known linear distance equal to or similar to the estimated distance to the target. This process is cumbersome to the hunter, requires extra time which instead could be spent focusing on and preparing to shoot the target, and requires extra movement, which can frequently spook the animal, resulting in the animal escaping before the hunter can take a shot.

SUMMARY

Embodiments of the present invention are directed towards an apparatus and method for, among other things, quickly determining distances to a target when a bow hunter is located at a fixed elevated position. The embodiments of the present invention include a distance indicating mechanism for use in combination with a bow sight and a method of calibrating a bow sight for use at an elevated position.

In one embodiment, a distance indicating mechanism is disclosed that accounts for the operator's height when determining a distance to a target. The mechanism is a fluid-filled tubular device mounted to a bow sight and includes an indicating device capable of generating one or more indications on the tubular device that correspond to known distances to a target.

In an alternate embodiment of the present invention, a bow sight is disclosed having a mounting bracket capable of adjustment along multiple axes of the mounting bracket, a plurality of adjustable sight pins for setting linear distance targets for the bow sight, and a pin guard for protecting the pins from accidental contact with other items that might damage or move the pins. A generally tubular fluid-filled device having at least one indicating device is fixed adjacent to the sight guard or incorporated into the sight guard and aids in determining a distance to a target when the bow operator is located at a fixed vertical distance above the ground.

In yet another embodiment, a method of calibrating a distance indicating mechanism with a bow sight for target distances when the bow sight is positioned at a vertical height is disclosed. The method comprises establishing a plurality of known linear distances corresponding to one or more sight pins of a sight guard and establishing a fixed vertical height from which the bow sight will be used. A target distance from the vertical height is measured and the corresponding position of the fluid in the tubular device is noted and marked with an indicator. The target distance generally corresponds to a known linear distance established by the sight pins of the bow sight.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventor has contemplated that the claimed subject matter might also be embodied in other ways, to include different components, combinations of components, steps, or combinations of steps similar to the ones described in this document, in conjunction with other present or future technologies.

Figure 1:
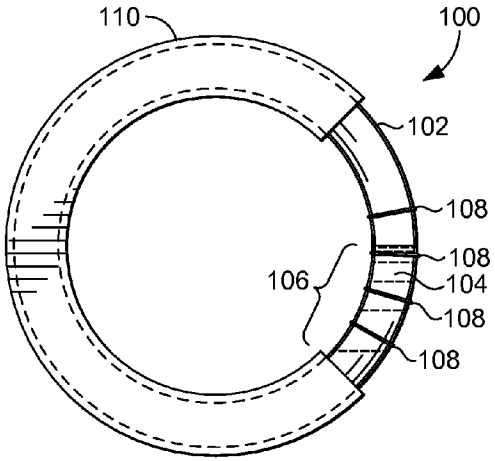
FIG. 1 is a side elevation view of a distance indicating mechanism in accordance with an embodiment of the present invention.
Figure 2:
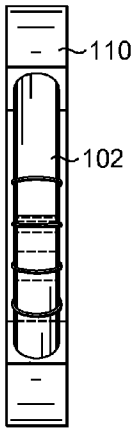
FIG. 2 is an end elevation view of the distance indicating mechanism of FIG. 1.
Figure 3:
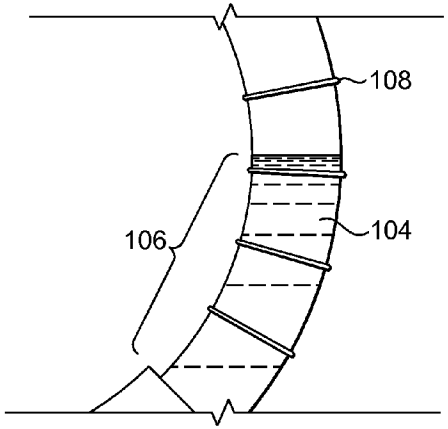
FIG. 3 is an enlarged fragmentary view of a portion of the distance indicating mechanism of FIG. 1.

Referring initially to FIGS. 1-3, an embodiment of a distance indicating mechanism 100 for use with an archery or hunting bow is shown. The mechanism 100 includes a tubular device 102 having a generally circular shape which can be fabricated from a variety of materials, but is generally thin-walled and at least a portion of which has a transparent or translucent quality, such as that of clear plastic or glass. A fluid 104, preferably having a colored tint, is contained within the tubular device 102, and the fluid is capable of remaining in a liquid state below approximately 32 degrees Fahrenheit. One such acceptable fluid for the tubular device 102 would be anti-freeze. The fluid should not completely fill the tubular device 102, but instead should fill up to approximately 75% of the total volume so as to permit sufficient movement of the fluid level within the tubular device 102.

The distance indicating mechanism 100 also includes an indicating device 106, located on the fluid-filled tubular device 102, that is capable of generating one or more indications that correspond to known distances at a fixed vertical height. For the embodiment of the present invention illustrated in FIGS. 1-3, the indicating device 106 comprises a series of bands 108 that are positioned around the tubular device 102 at various fluid levels. The bow operator can remove or adjust the bands 108 as necessary.

In order to protect the tubular device 102 from damage and improve ease of use, an embodiment of the present invention includes an external case 110 encompassing at least a portion of the tubular device 102. In the embodiment illustrated in FIGS. 1-3, the external case 110 has a general "C" shape and is preferably non-transparent in order to limit the viewable area of the tubular device 102. In the embodiment depicted in FIGS. 1-3, the viewable area is limited to approximately 25% of the tubular volume. Further, an interior portion of the external case 110 opposite the indicating device 106 may be coated with a dark material or a color that contrasts with the tinted fluid 104 to make the level of the fluid readily ascertainable.

Figure 4:
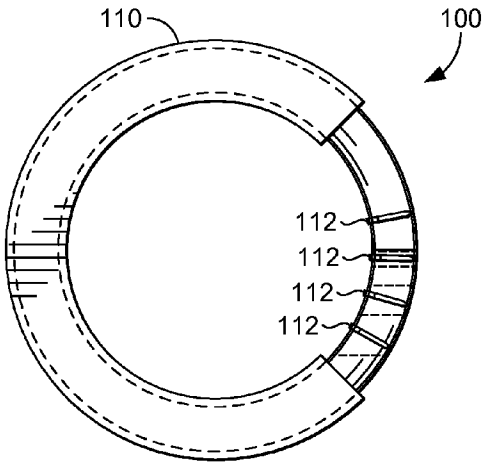
FIG. 4 is a side elevation view of a distance indicating mechanism in accordance with an alternate embodiment of the present invention.
Figure 5:
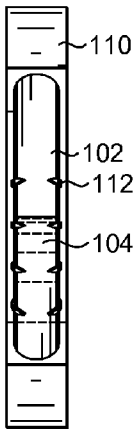
FIG. 5 is an end elevation view of the distance indicating mechanism of FIG. 4.
Figure 6:
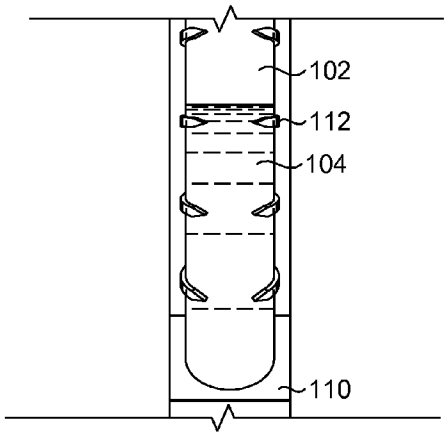
FIG. 6 is an enlarged fragmentary view of a portion of the distance indicating mechanism of FIG. 4.

The indicating device 106 is not limited to a plurality of movable bands 108 to create the indications. An alternate form of the indicating device 106 includes a plurality of clips 112, as illustrated in FIGS. 4-6. Specifically, the clips can be a band that partially encompasses the tubular device 102. The clips 112 are placed at desired levels of fluid positions on the tubular device 102. The clips 112 may be adjustable and removable.

Figure 9:
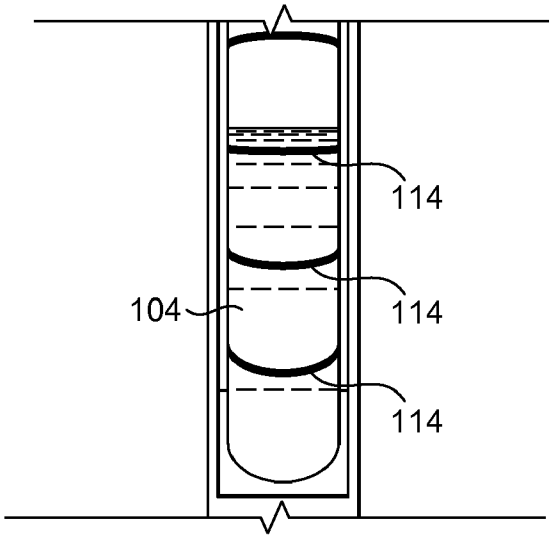
FIG. 9 is an enlarged fragmentary view of a portion of the distance indicating mechanism of FIG. 7.
Figure 8:
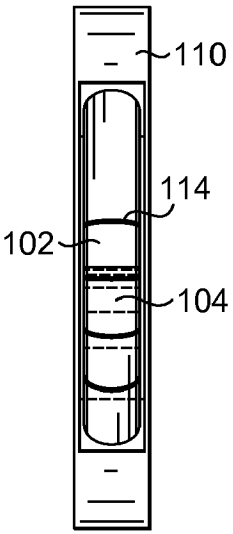
FIG. 8 is an end elevation view of the distance indicating mechanism of FIG. 7.
Figure 7:
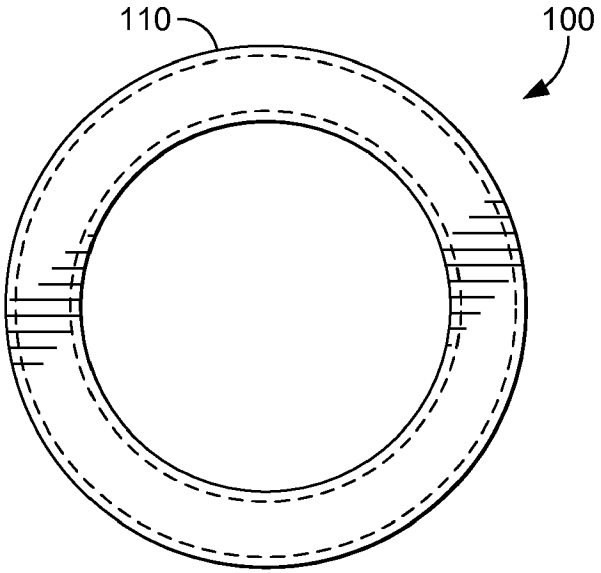
FIG. 7 is a side elevation view of a distance indicating mechanism in accordance with yet another embodiment of the present invention.
Figure 10:
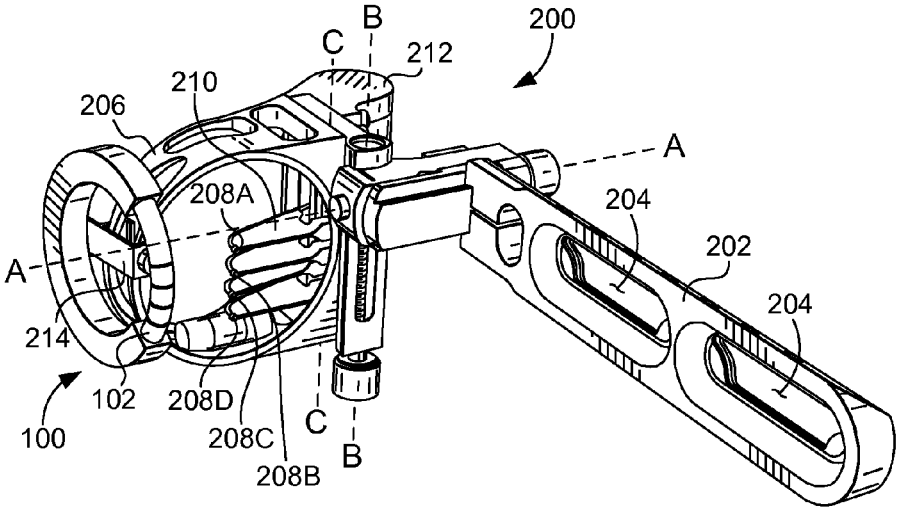
FIG. 10 is a perspective view of a bow sight having a distance indicating mechanism coupled thereto in accordance with an embodiment of the present invention.
Figure 11:
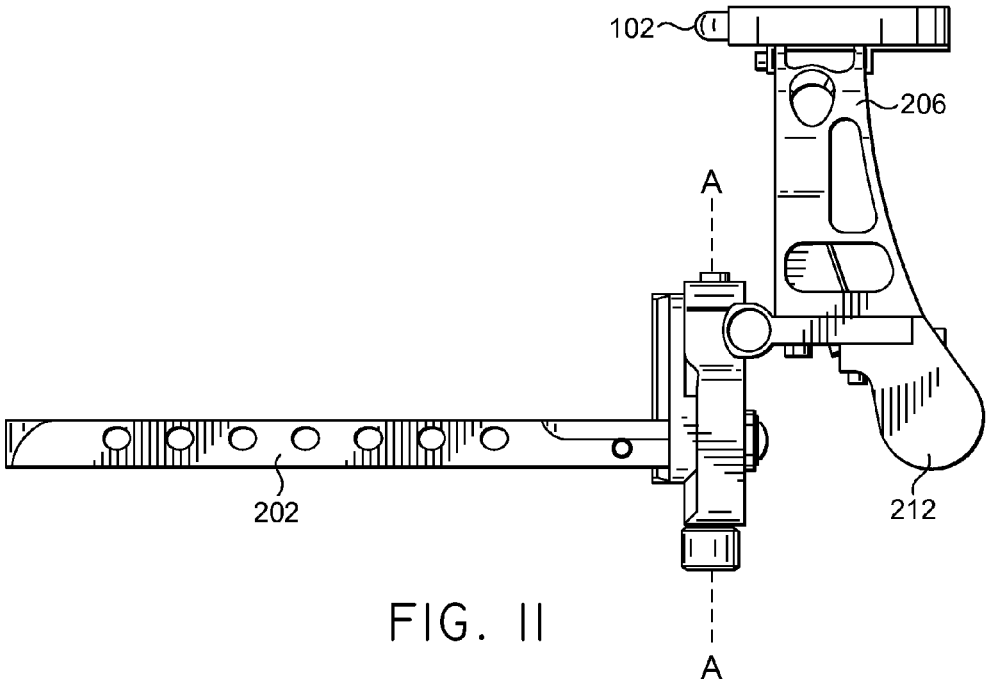
FIG. 11 is a top plan view of the combination of FIG. 10.
Figure 12:
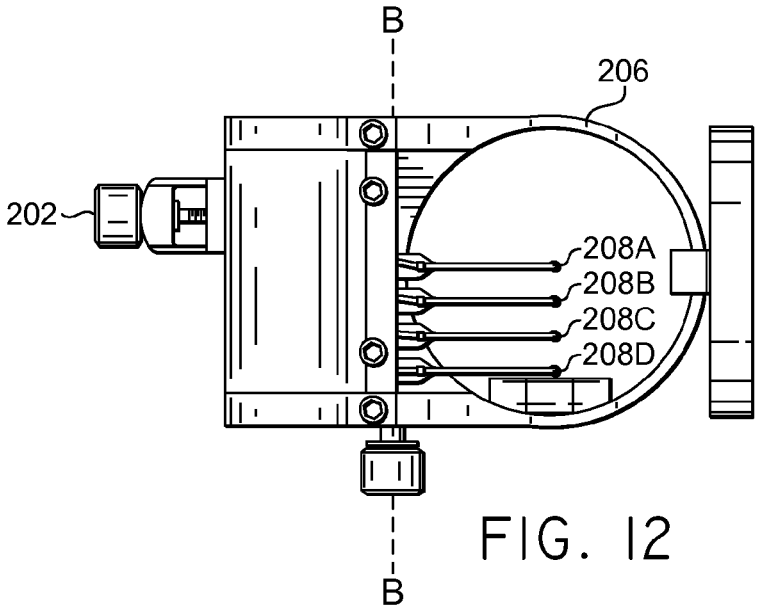
FIG. 12 is a front elevation view of the combination of FIG. 10.
Figure 13:
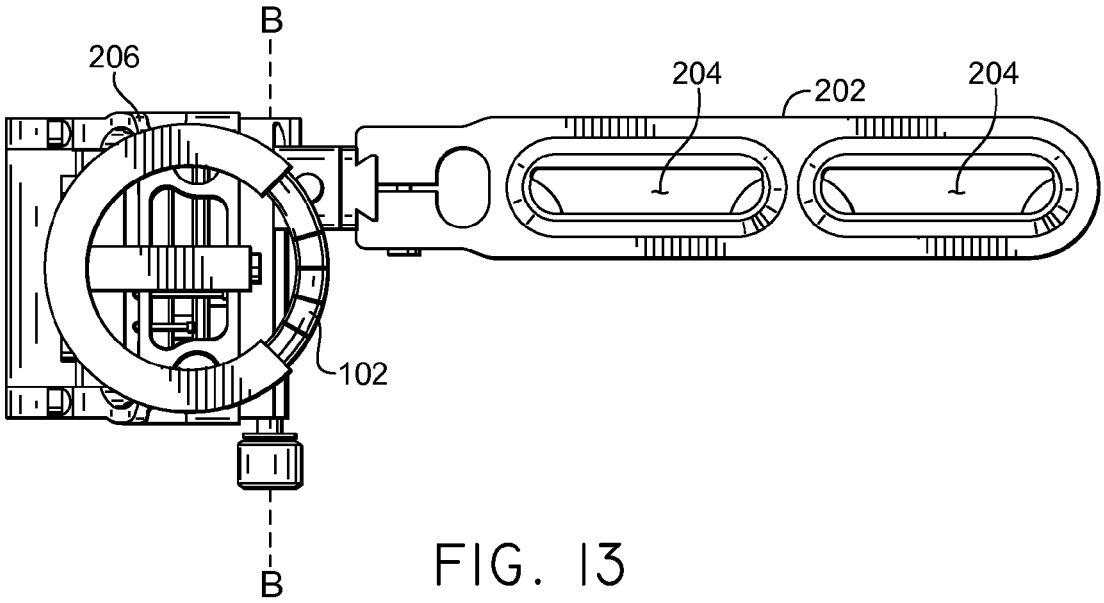
FIG. 13 is a side elevation view of the combination of FIG. 10.
Figure 14:
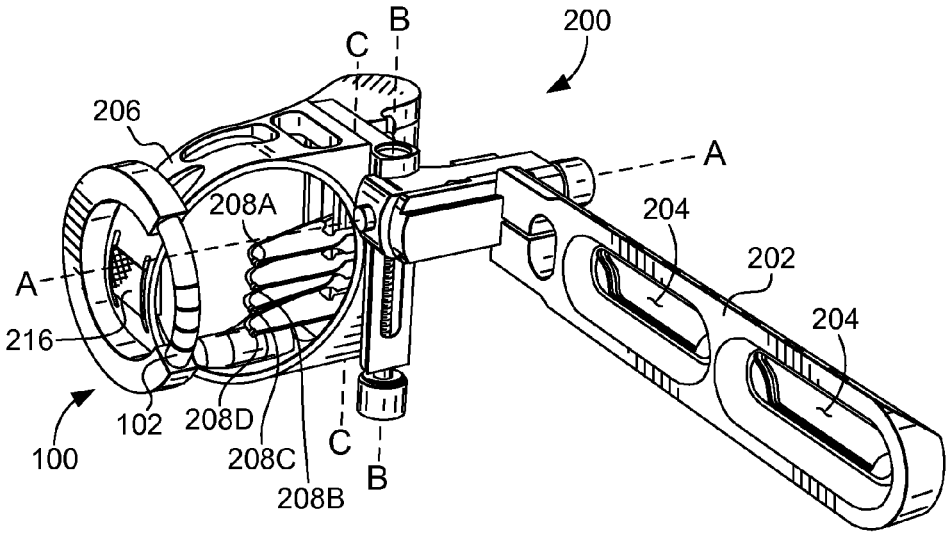
FIG. 14 is a perspective view of a bow sight having a distance indicating mechanism coupled thereto in accordance with an alternate embodiment of the present invention.
Figure 15:
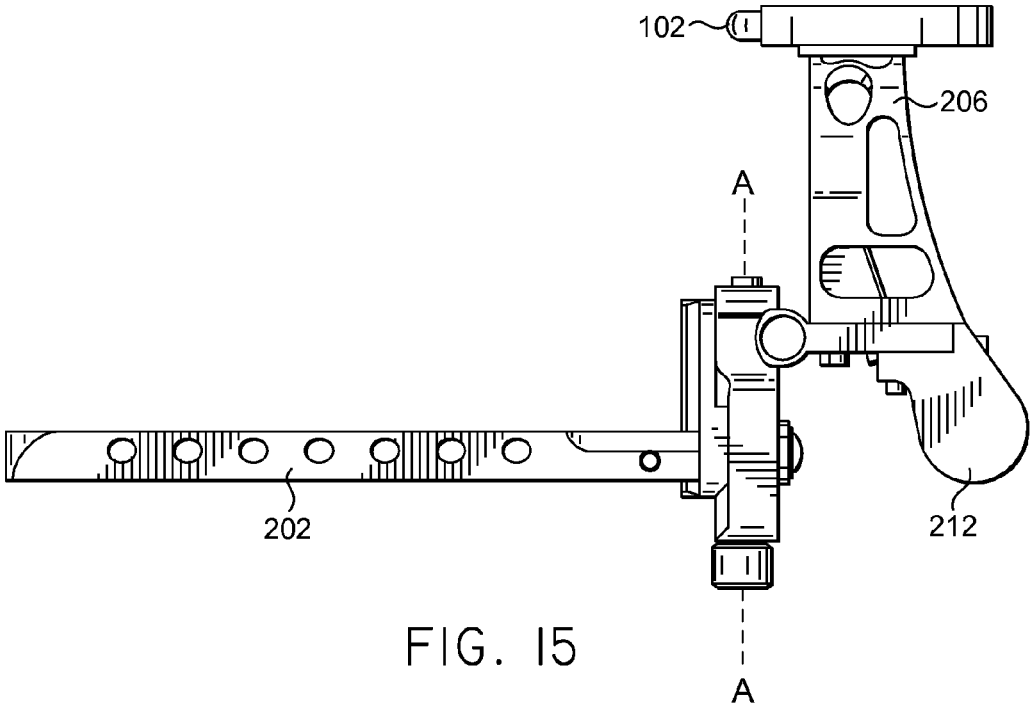
FIG. 15 is top plan view of the combination of FIG. 14.
Figure 16:
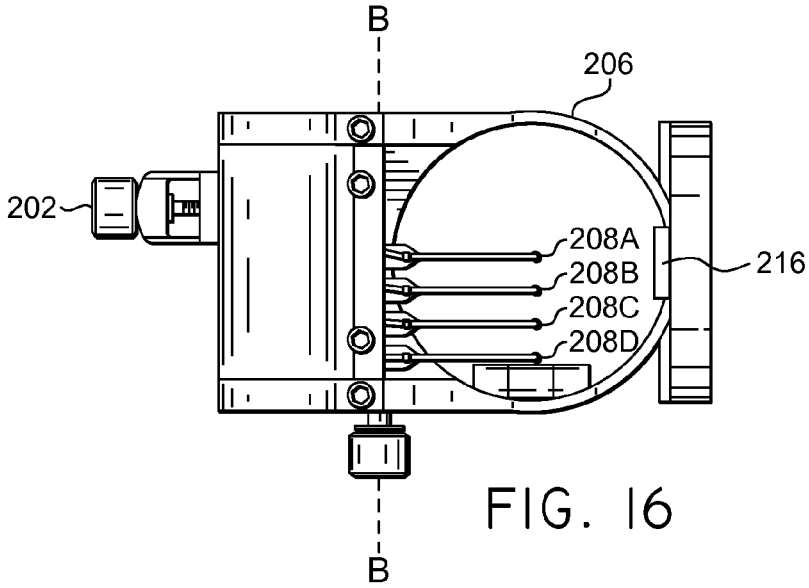
FIG. 16 is a front elevation view of the combination of FIG. 14.
Figure 17:
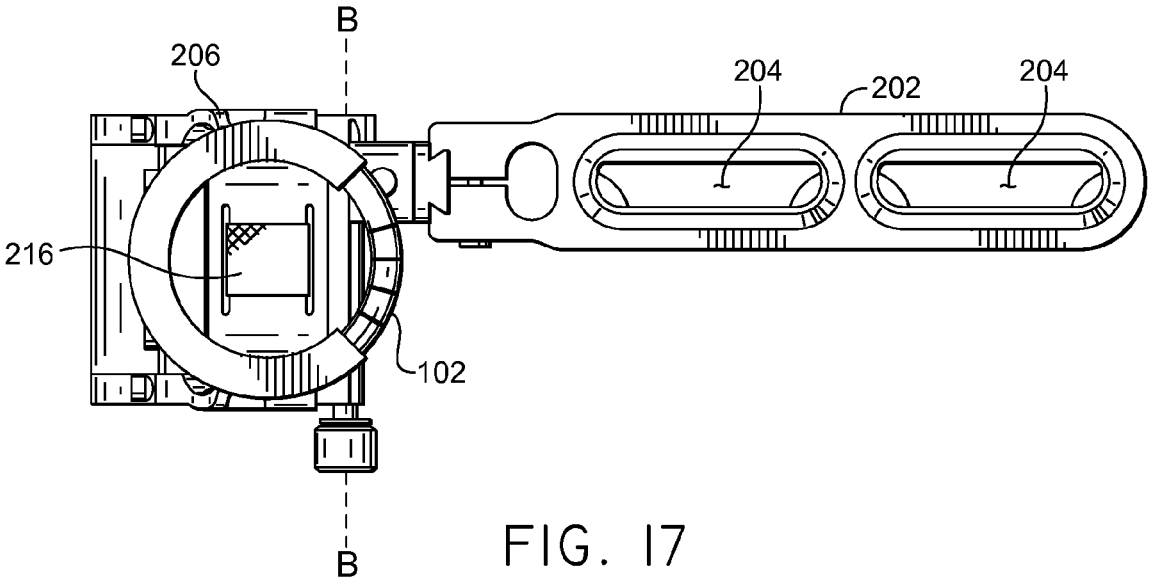
FIG. 17 is a side elevation view of the combination of FIG. 14.
Figure 18:
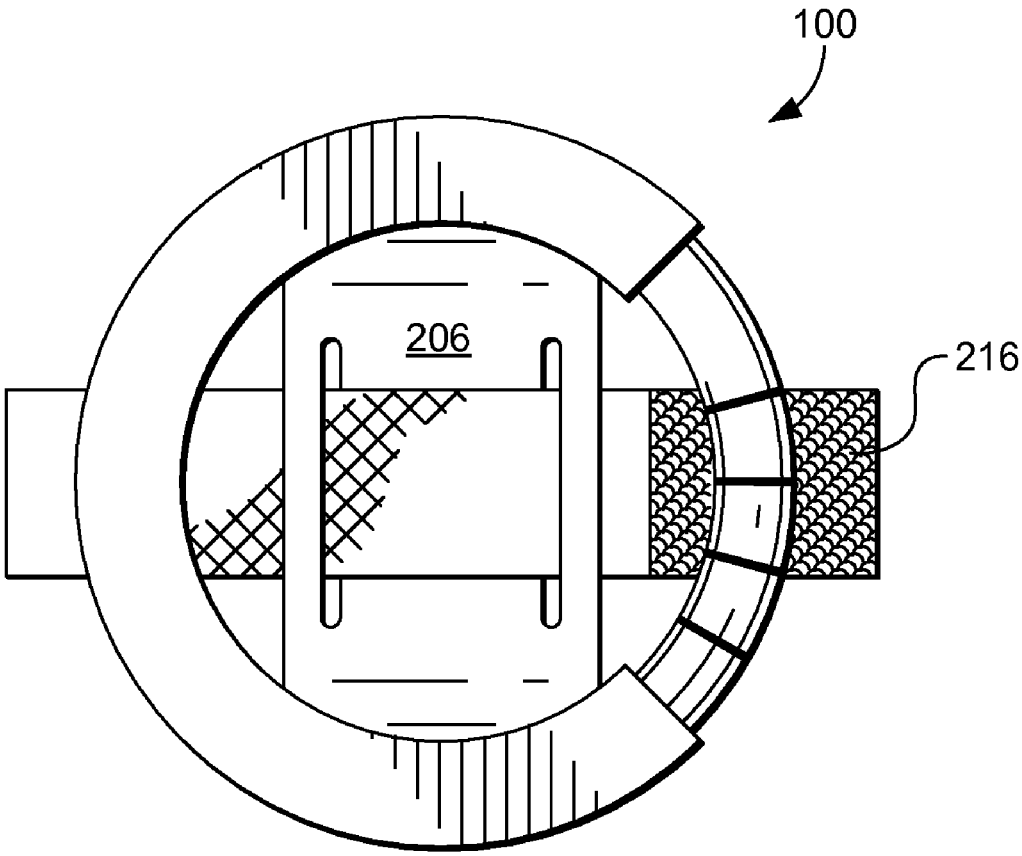
FIG. 18 is an enlarged fragmentary view of a portion of FIG. 17 illustrating where the distance indicating mechanism is secured to a guard of the bow sight.
Figure 19:
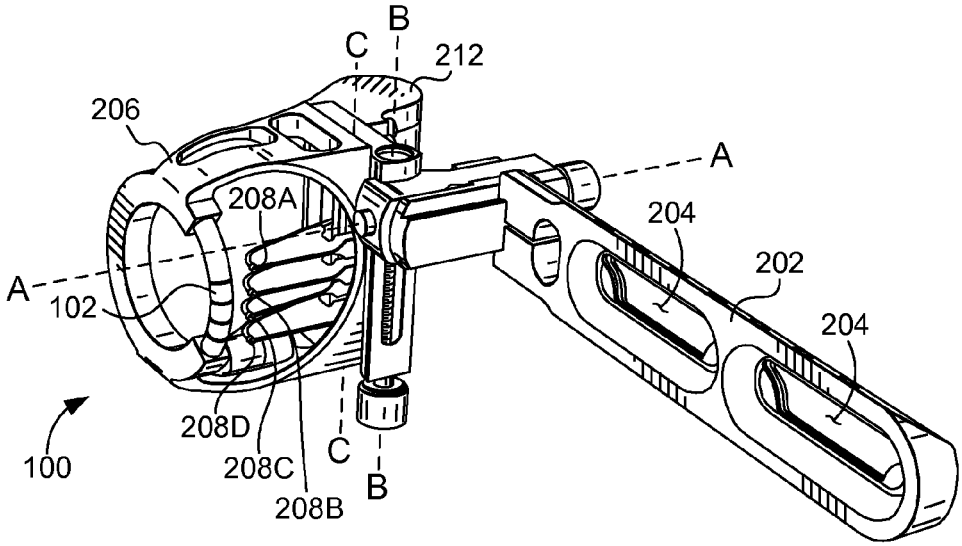
FIG. 19 is a perspective view of a bow sight having a distance indicating mechanism incorporated into a guard thereof in accordance with yet another alternate embodiment of the present invention.
Figure 20:
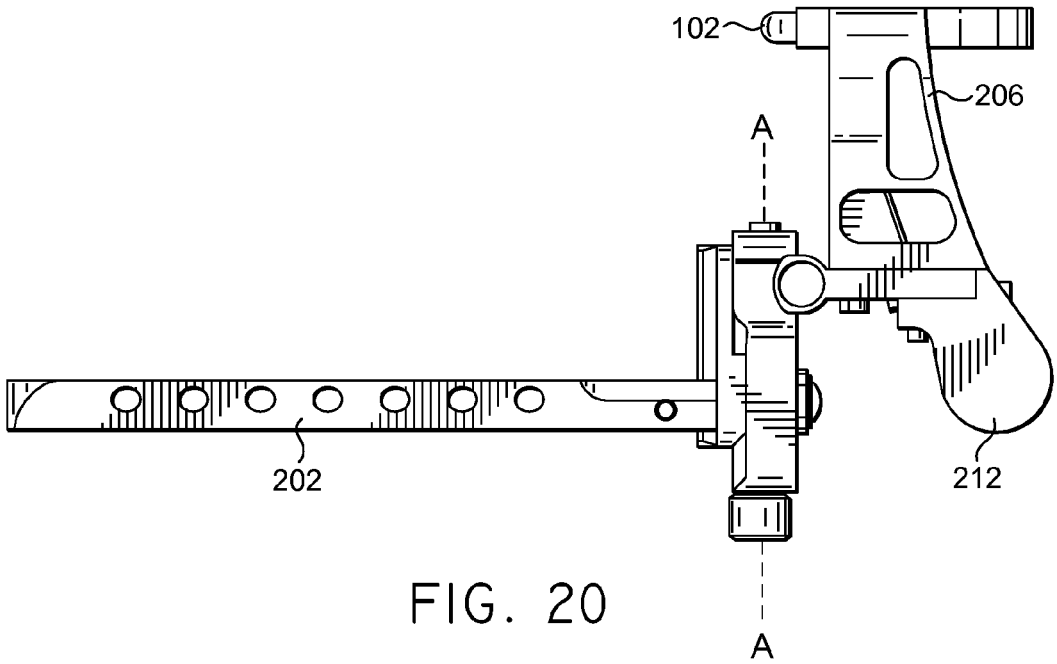
FIG. 20 is top plan view of the combination of FIG. 19.
Figure 21:
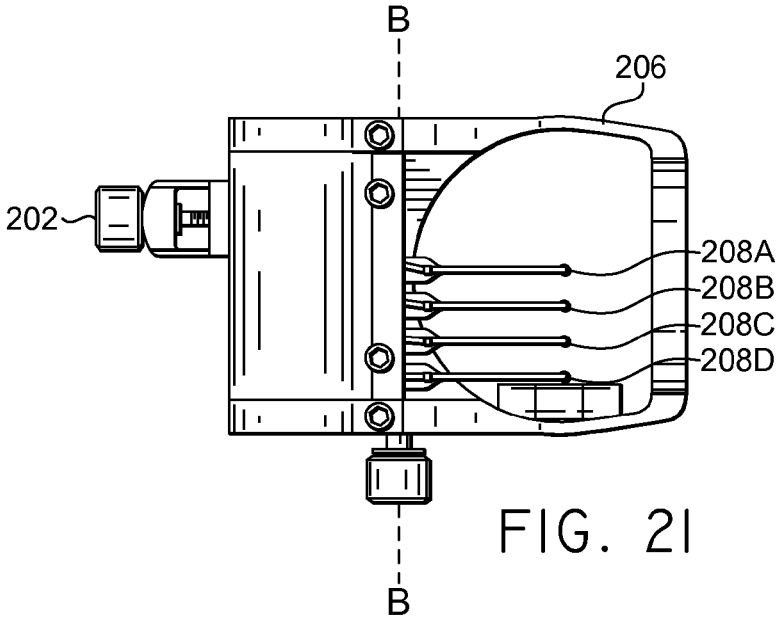
FIG. 21 is a front elevation view of the combination of FIG. 19.
Figure 22:
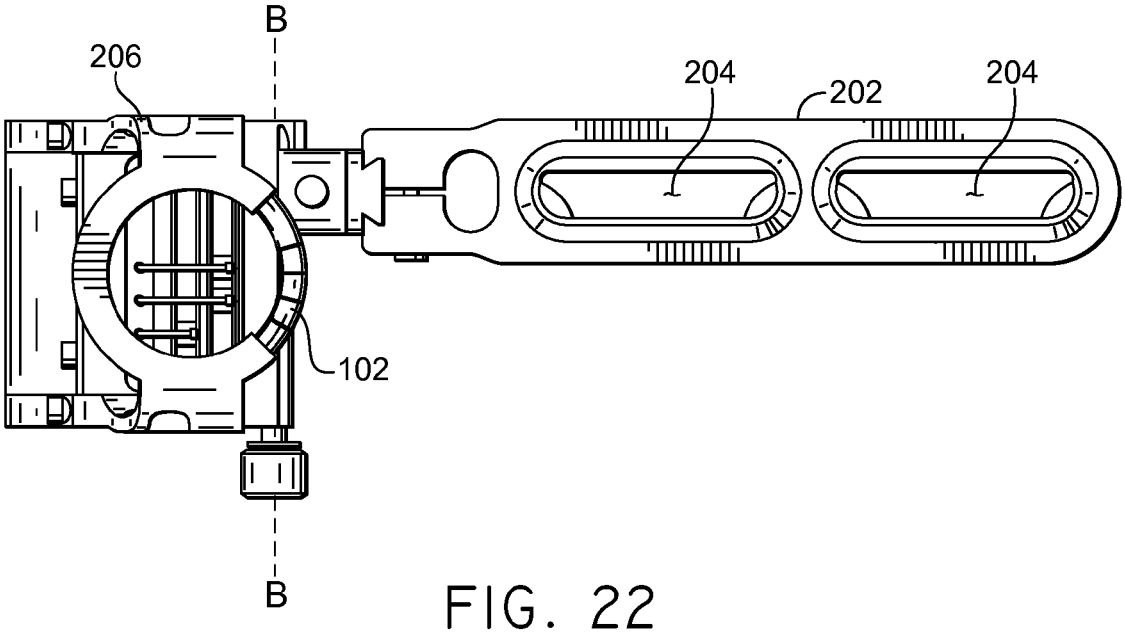
FIG. 22 is a side elevation view of the combination of FIG. 19.

Referring to yet another embodiment of the present invention illustrated in FIGS. 7-9, the indicating device 106 does not have to be a separate component, such as a band or clip, but can instead be one or more marks 114 placed directly on the tubular device 102 by the operator. The marks 114 are preferably made on the indicating device by a removable ink or other temporary marking such that should the bow operator change vertical heights from which he is shooting, he can recalibrate the distance indicating mechanism 100 by making a new set of marks 114 on the tubular device 102.

Figure 25:
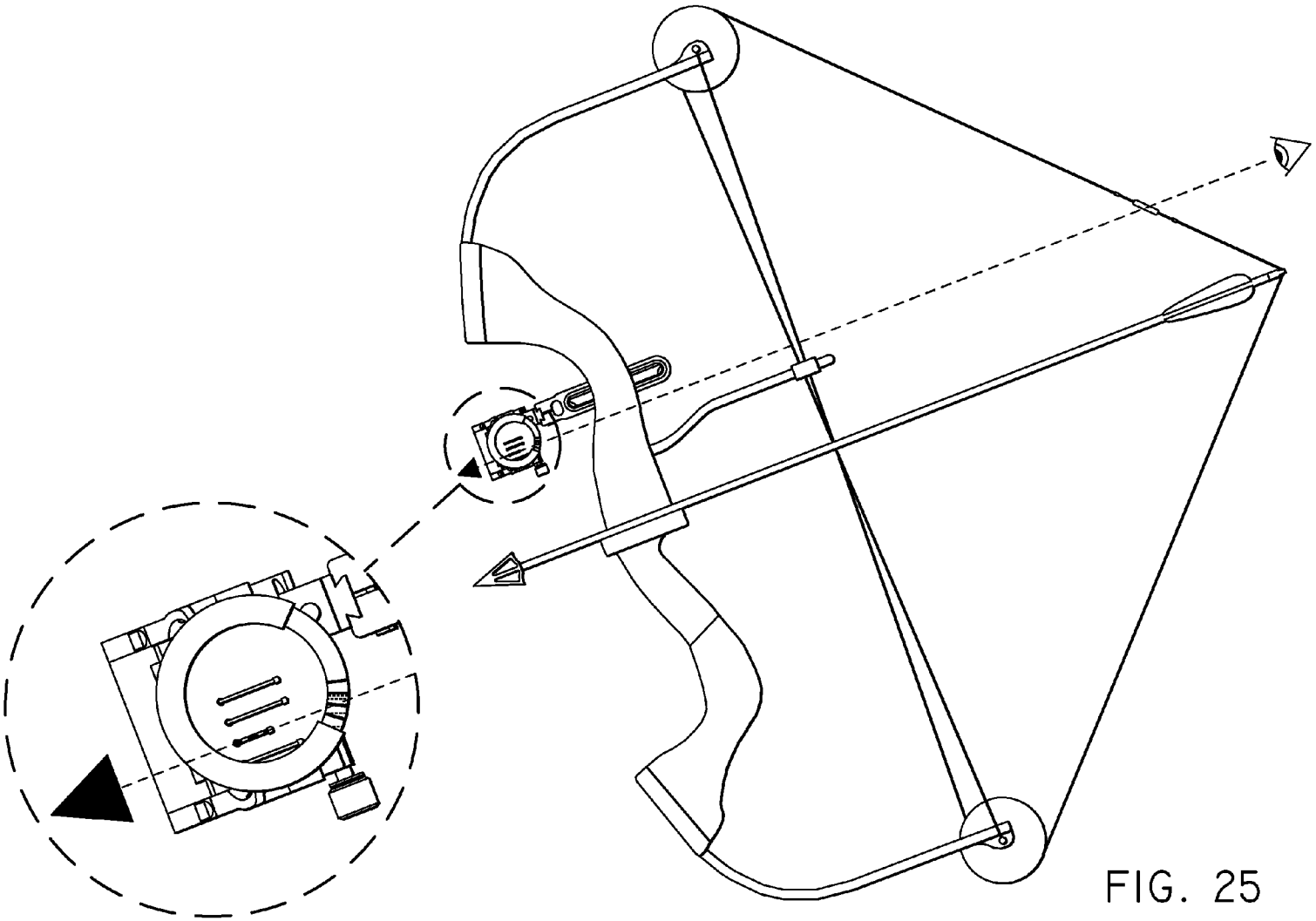

Referring now to FIGS. 10-13, an embodiment of the present invention is depicted in which a distance compensating mechanism 100 is coupled with a bow sight 200. Specifically, the bow sight 200 has a mounting bracket 202 with at least one opening 204 for securing the bow sight 200 to a bow 300, as shown in FIG. 25. The bow sight 200 also has a sight guard 206 that is capable of adjustment along a generally horizontal axis A-A and a generally vertical axis B-B, relative to the mounting bracket 202. The sight guard 206 has a plurality of sight pins 208A-208D that are adjustable in a vertical direction along an axis C-C, which is coaxial to the vertical axis B-B. The exact number of sight pins 208A-208D can vary depending on the size of the sight guard 206 and the desired number of fixed shooting distances.

The plurality of sight pins 208A-208D are used to establish a particular linear distance from which an arrow can be shot from a bow using the bow sight 200. For example, it is understood that for a given vertical position of a sight pin within a sight guard 206, an arrow can be shot a known linear distance. More specifically, the sight pins can be set to establish known linear distances at specific intervals such as 10 yards, 20 yards, 30 yards, and 40 yards, with the uppermost sight pin 208A set to 10 yards and the bottommost sight pin 208D set to 40 yards. Although the sight pins 208A-208D can be fabricated from a variety of materials, one embodiment includes fiber optic wire 210, which provides an illuminated sight pin. The fiber optic wire is wound around a spool, to provide greater surface area for collecting ambient light and delivering it to an end of a sight pin, and is stored in a compartment 212.

Coupled with the bow sight 200, is a distance indicating mechanism 100 with a generally tubular device 102 having a fluid contained therein, as previously discussed with respect to FIGS. 1-9. The tubular device 102 has an indicating device 106, such as a band, clip, or mark located thereon to establish a correlation between an elevated position and a particular distance to a target. The tubular device 102 is positioned adjacent an edge of the sight guard 206 opposite of the mounting bracket 202 and is generally centered perpendicular to the sight guard 206. The distance indicating mechanism 100 can be removably coupled to the sight guard 206 by a fastener or clamp 214, as illustrated in FIGS. 10-13, or a strap 216, as illustrated in FIGS. 14-18. The strap 216 can be a cloth-type hook and loop fastener, such as Velcro®, a plastic band, a metallic band, or a tape. In an alternate embodiment, the tubular device 102 can be fabricated integrally with the sight guard 206, as illustrated in FIGS. 18-22.

Figure 23B:
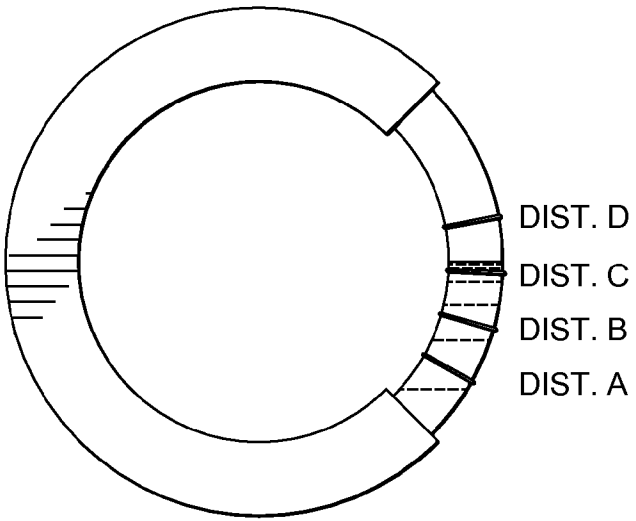
FIG. 23B is a side elevation view of a distance indicating mechanism when oriented at an angle relative to the horizon in accordance with an embodiment of the present invention.
Figure 23A:
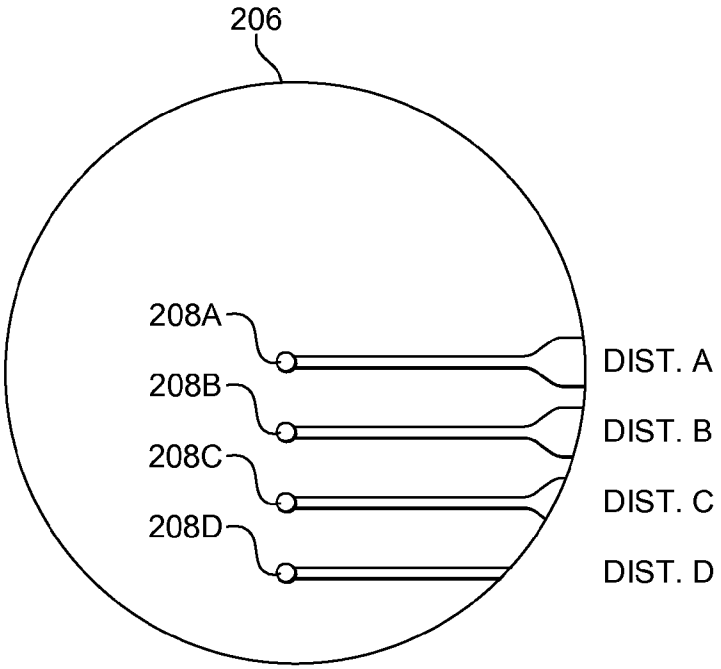
FIG. 23A is a schematic front elevation view through a pin guard of a bow sight in accordance with an embodiment of the present invention.

The present invention is used to provide a visual correlation between known linear distances for which an arrow can be shot from a bow 300 using a bow sight 200 and a fixed elevated position of the bow operator. Traditionally, based on the height of the sight pins 208A-208D in the sight guard 206, an arrow can travel different predetermined distances. For example, with reference to FIG. 23A, a sight guard 206 with a plurality of sight pins 208A-208D are shown. As one skilled in the art will understand, when shooting an arrow using a bow sight while positioned on the ground, the arrow will travel furthest when aimed using the lowest pin in the sight guard 206, such as sight pin 208D. This is because, when aimed using the lowest pin, the bow is rotated such that the arrow is positioned to be shot at its highest trajectory and, thus, the arrow will travel farther before arriving at a predetermined height than if the arrow was shot at a lower trajectory. Based on the spacing of the sight pins 208A-208D along the axis C-C, the sight pins 208A-208D can be set to establish linear target distances, such as at equal 10 yard intervals (i.e. 10 yards, 20 yards, 30 yards, and 40 yards).

Figure 24:
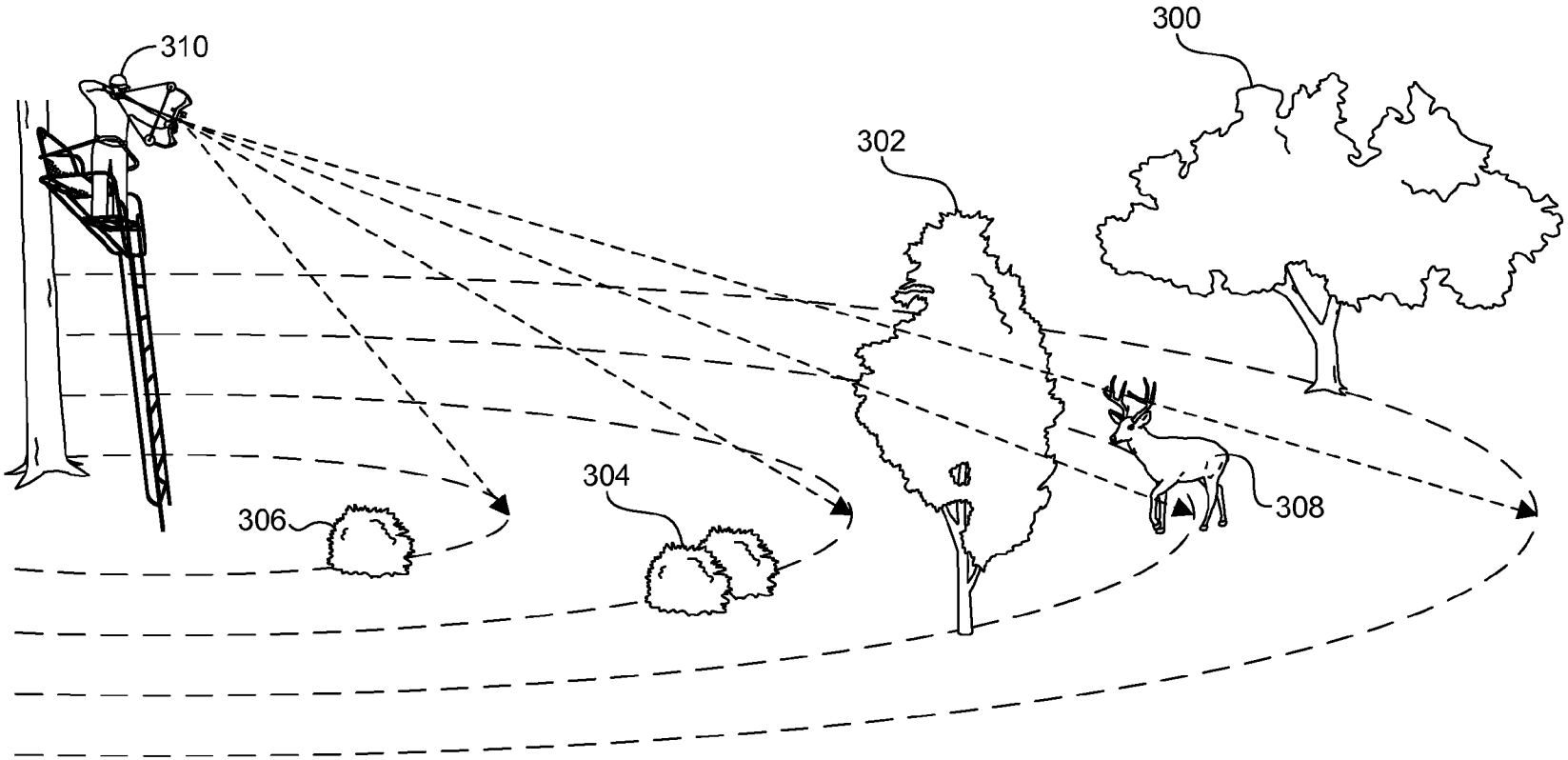
FIG. 24 illustrates a situation in which a hunter is located at an elevated position and uses a bow equipped with an embodiment of the present invention to target an animal; and, FIG. 25 illustrates the aligning of a bow operator's line of sight with a pin of a bow sight based on a distance indicated by the indicator level shown in an embodiment of the present invention.

However, when the operator is located in an elevated position, such as in a tree stand, as depicted by FIG. 24, the linear distance the arrow must travel to the target is not the same as when the operator was located on the ground. Since tree stands are typically kept at a fixed height and bow operators often utilize the same stand, it is possible to then establish a correlation between the known linear distances of the bow sight and the elevation of the operator.

Referring to FIGS. 23A, 23B, 24, and 25, once a plurality of linear distances are set in the bow sight 200 via the sight pins 208A-208D (by shooting at targets known distances away on level ground) and the vertical height for an operator is set (by a tree stand or other support), an operator can measure a target distance from the raised location in the tree stand (such as by using a range finder) and correlate the measured target distance to one of the known sight pin linear distances by aiming. To ensure repeated accuracy to this target distance from the elevated position, the operator then identifies the fluid level position in the tubular device 102 corresponding to the orientation of the bow while aiming at the measured target distance and places an indicator at the fluid level position on the tubular device 102 corresponding to the target distance. Subsequently, when the bow operator is at the elevated position and a target is located, the operator can quickly ascertain a distance to a target by aiming an arrow at the target and looking at the resulting level of the fluid in the distance indicating mechanism 100. Based on the particular indicator on the tubular device 102 closest to the fluid level, the operator can determine the distance to the target and thereby know which sight pin 208A-208D to align his sight with in order for the arrow to be at the proper height when it reaches the target.

For example, the bow operator can establish the sight pins 208A-208D at four distances (Distance A, B, C, and D) by shooting at targets while standing on the ground. One such set of distances can be 10 yard intervals where Distance A=10 yards, Distance B=20 yards, Distance C=30 yards, and Distance D=40 yards). The operator then climbs into the tree stand and, using a standard range finder or other device, determines a target distance to fixed objects within the bow operator's range, such as the trees 300 and 302 or bushes 304 and 306, as shown in FIG. 23. In this example, the tree 302 measures a target distance of approximately 30 yards (or Distance C) from the bow operator's elevated position. The operator would then aim the bow and arrow for a shot at the base of the tree 302 and place an indicator on the tubular device 102 at the fluid level position in the indicating device 100 corresponding to a shot at a target a Distance C away. Therefore, when a hunting target comes within the operator's range, and the fluid level in the tubular device 102, when aiming the arrow at the target, aligns the indicator for a Distance C, the bow operator will know that the target is approximately 30 yards away and he should align his shot with the sight pin 208C, which is set to have the arrow be vertically where aiming when at a distance of 30 yards away.

For example, once a target such as a deer 308, comes within the sight of the bow operator, instead of trying to determine the distance to the deer 308 by using a range finder, in accordance with the prior art method, the operator can simply aim the arrow at the deer 308 and determine the distance to the deer based on the angle of rotation of the bow as indicated by the fluid level in the tubular device 102 on his bow sight 200. With the distance to the target known, as depicted in FIG. 25, the bow operator then selects the appropriate sight pin for which to align his sight with, in order to ensure that his arrow, when shot, will travel the sufficient distance to strike the target where the bow operator is aiming.

The present invention improves operability of a bow sight for use at a fixed elevated height. However, incorporating a distance indicating mechanism with a bow sight does not adversely impact or alter the use of a bow sight when the bow operator is located on the ground and not at an elevated position.

The present invention has been described in relation to particular embodiments, which are intended in all respects to be illustrative rather than restrictive. Alternative embodiments will become apparent to those of ordinary skill in the art to which the present invention pertains without departing from its scope. For example, the indicators of the indicating device 106, such as the movable bands 108 or clips 112, can be color coated to correspond with the colors of the sight pins 208A-208D. By way of example, the band 108 highest up the tubular device 102, which indicates Distance D, the furthest distance, can be made to be red in color. In such case, the lowest sight pin 208D, which is used to shoot an arrow a Distance D, also the furthest distance, can be made to be red in color as well. This way the bow operator can quickly match the color indicating distance with the same color shooting distance to make a shot of the proper distance.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A sight for an archery bow, the sight comprising:

a mounting bracket;

a sight guard capable of adjustment along a generally horizontal axis and a generally vertical axis relative to the mounting bracket and having a plurality of adjustable sight pins, where each sight pin is positionable to correspond to a particular linear distance where an arrow shot from a bow will be at a desired vertical height; and a generally tubular fluid-filled device coupled with the sight guard and adjacent to the sight pins, wherein the device includes at least one indicator located thereon for establishing a distance to a target corresponding to a level of the fluid in the fluid-filled device based on the orientation of the fluid-filled device.

2. The bow sight of claim 1, wherein the fluid-filled device is generally circular in shape.

3. The bow sight of claim 2, wherein the fluid-filed device is generally in a vertical plane and wherein the plane is generally perpendicular to the sight pins.

4. The bow sight of claim 1, wherein the fluid-filled device is removably coupled with the sight guard.

5. The bow sight of claim 1, wherein the mounting bracket has at least one opening for securing the bow sight to the bow, wherein the sight pins are adjustable in a vertical plane, and wherein the sight pins include a plurality of fiber optic wires.

6. The bow sight of claim 1, wherein the fluid-filled device contains a fluid capable of remaining in a liquid state below approximately 32 degrees Fahrenheit.

7. The bow sight of claim 1, wherein the fluid-filled device is coupled to the sight guard adjacent an edge of the sight guard opposite the mounting bracket.

8. The bow sight of claim 1, wherein the fluid-filled device is integrally formed in the sight guard.

9. The bow sight of claim 1, wherein the indicator is selected from a group comprising: a band, a clip, and a removable mark positioned on the fluid-filled device.

10. The bow sight of claim 9, wherein the device includes a plurality of indicators, wherein each of the sight pins includes a color not on other sight pins to distinguish it from adjacent sight pins, wherein each of the indicators includes a color not on other indicators to distinguish it from adjacent indicators, and wherein the colors of the sight pins correspond with the colors of the indicators.

11. A method of aiming a bow to shoot an arrow at a target from a position spaced laterally from and vertically above the target, the bow having a sight thereon, the sight having a plurality of pins thereon which correspond to a known distance for shooting the arrow and a generally tubular fluid-filled device adjacent the sight pins, the device having a plurality of indicators thereon which correspond to a known orientation of the bow and a known distance from the position, the method comprising:

pointing the arrow generally at the target while nocked in the bow;

determining a distance from the position to the target by identifying a position of the fluid level within the tubular device and its relation to one or more of the indicators; and aiming the arrow to shoot the determined distance by rotating the bow to align the pin corresponding with the determined distance with the target.

12. The method of claim 11, wherein each pin has a color, wherein each indicator has a color, and wherein the colors of the pins correspond with the colors of the indicators, whereby an indicator of a first distance has the same color as a pin corresponding to that same first distance.

13. The method of claim 11, wherein the indicators are selected from a group comprising: a band, a clip, and a removable mark positioned on the fluid-filled device.

14. The method of claim 11, wherein the indicators can be removed, adjusted, or re-established when a vertical height of the bow operator changes with respect to the target.

15. The method of claim 11, wherein the generally tubular fluid-filled device is removably coupled with the sight.

16. The method of claim 11, wherein the site includes a guard which surrounds and protects the pins from getting bumped and wherein a housing of the generally tubular fluid-filled device is integrally formed within the guard of the sight.

* * * * *